US009224335B2

(12) United States Patent
Yoon et al.

(10) Patent No.: US 9,224,335 B2
(45) Date of Patent: Dec. 29, 2015

(54) ORGANIC LIGHT EMITTING DIODE DISPLAY DEVICE AND METHOD FOR DRIVING THE SAME

(71) Applicant: LG DISPLAY CO., LTD., Seoul (KR)

(72) Inventors: Sang-Hun Yoon, Gimje-si (KR); Jung-Min Lee, Paju-si (KR)

(73) Assignee: LG DISPLAY CO., LTD., Seoul (KR)

( * ) Notice: Subject to any disclaimer, the term of this patent is extended or adjusted under 35 U.S.C. 154(b) by 71 days.

(21) Appl. No.: 14/135,022

(22) Filed: Dec. 19, 2013

(65) Prior Publication Data

US 2014/0184665 A1 Jul. 3, 2014

(30) Foreign Application Priority Data

Dec. 28, 2012 (KR) ..... 10-2012-0157007

(51) Int. Cl.
*G09G 3/32* (2006.01)

(52) U.S. Cl.
CPC ..... *G09G 3/3241* (2013.01)

(58) Field of Classification Search
CPC ..... G09G 3/3241; G09G 3/30; G09G 3/32; G09G 3/2018; G09G 3/3208; G09G 3/3233; G09G 2300/0809
See application file for complete search history.

(56) References Cited

U.S. PATENT DOCUMENTS

2003/0117362 A1 6/2003 An
2006/0107143 A1 5/2006 Kim et al.
2007/0273620 A1 * 11/2007 Yumoto ..... 345/76
2008/0170010 A1 7/2008 Kim
2009/0295772 A1 12/2009 Kim et al.
2010/0188377 A1 * 7/2010 Ota et al. ..... 345/205
2010/0259468 A1 10/2010 Omoto et al.
2011/0157143 A1 * 6/2011 Choi et al. ..... 345/212
2011/0164021 A1 7/2011 Seto
2011/0285691 A1 11/2011 Takasugi et al.

FOREIGN PATENT DOCUMENTS

CN 1766974 A 5/2006
CN 101226719 A 7/2008

(Continued)

OTHER PUBLICATIONS

English translation of the Chinese application CN 101986378 A, Pixel driving circuit for active organic light emitting diode (OLED) display and driving method thereof, Wu et al., Mar. 16, 2011.*

*Primary Examiner* — Larry Sternbane
*Assistant Examiner* — Ivelisse Martinez Quiles
(74) *Attorney, Agent, or Firm* — Birch, Stewart, Kolasch & Birch, LLP

(57) ABSTRACT

Discussed are an organic light emitting diode (OLED) display device and a method for driving the same. The OLED display device includes pixels each including a light emitting element, and a pixel driving circuit. The pixel driving circuit includes a driving switching element connected in series between high and low-level voltage supply lines, together with the light emitting element, a first switching element for connecting a data line and a first node connected to a gate of the driving switching element in response to a first scan signal, a second switching element for connecting an initialization voltage supply line and a second node connected to a source of the driving switching element in response to a second scan signal, and a third switching element for connecting the high-level voltage supply line and a drain of the driving switching element in response to an emission signal.

13 Claims, 7 Drawing Sheets

(56) References Cited

FOREIGN PATENT DOCUMENTS

| | | | |
|---|---|---|---|
| CN | 101593767 | A | 12/2009 |
| CN | 101986378 | A | 3/2011 |
| CN | 102227763 | A | 10/2011 |
| GB | 2493800 | A | 2/2013 |
| KR | 10-2010-0073647 | A | 7/2010 |

* cited by examiner

ORGANIC LIGHT EMITTING DIODE DISPLAY DEVICE AND METHOD FOR DRIVING THE SAME

This application claims the benefit of the Korean Patent Application No. 10-2012-0157007, filed on Dec. 28,2012, which is hereby incorporated by reference as if fully set forth herein.

BACKGROUND OF THE INVENTION

1. Field of the Invention

The present invention relates to an organic light emitting diode (OLED) display device and a method for driving the same.

2. Discussion of the Related Art

Each of Pixels constituting an OLED display device includes an OLED constituted by an anode, a cathode, and an organic light emitting layer interposed between the anode and the cathode, and a pixel circuit for independently driving the OLED. The pixel circuit mainly includes a switching thin film transistor (TFT), a capacitor, and a driving TFT. The switching TFT charges a data voltage in the capacitor in response to a scan pulse. The driving TFT controls an amount of current supplied to the OLED in accordance with the data voltage charged in the capacitor, to adjust an emission intensity of the OLED.

In such an OLED display device, however, pixels thereof exhibit characteristic differences in terms of, for example, the threshold voltage (Vth) and mobility of driving TFTs, due to process deviation, etc. Voltage drop of a high-level voltage VDD may also occur. As a result, the amount of current to drive each OLED may vary and, as such, luminance deviation may be exhibited among the pixels. Generally, characteristic differences initially exhibited among driving TFTs may cause display of spots or patterns on a screen. On the other hand, characteristic differences exhibited among driving TFTs in accordance with operation of the driving TFTs to drive OLEDs may cause a reduction in the lifespan of an OLED display panel or generation of after images.

SUMMARY OF THE INVENTION

Accordingly, the present invention is directed to an organic light emitting diode display device and a method for driving the same that substantially obviate one or more problems due to limitations and disadvantages of the related art.

An object of the present invention is to provide an organic light emitting diode (OLED) display device and a method for driving the same, which are capable of reducing luminance deviation among pixels through compensation for characteristic differences of driving thin film transistors (TFTs) and compensation for voltage drop of a high-level voltage (VDD), thereby achieving an enhancement in picture quality.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, an organic light emitting diode display device includes a plurality of pixels each comprising a light emitting element, and a pixel driving circuit for driving the light emitting element, wherein the pixel driving circuit includes a driving switching element connected in series between a high-level voltage supply line and a low-level voltage supply line, together with the light emitting element, a first switching element for connecting a data line and a first node connected to a gate of the driving switching element in response to a first scan signal, a second switching element for connecting an initialization voltage supply line and a second node connected to a source of the driving switching element in response to a second scan signal, a third switching element for connecting the high-level voltage supply line and a drain of the driving switching element in response to an emission signal, and a first capacitor connected between the first node and the second node, wherein the pixel driving circuit operates in a period divided into an initialization period in which the pixel driving circuit turns on the first and second switching elements, to initialize the first and second nodes, a sampling period in which the pixel driving circuit turns on the first and third switching elements, to sense a threshold voltage of the driving switching element, a programming period in which the pixel driving circuit turns on the first switching element, to write a data voltage into the pixel, and an emission period in which the pixel driving circuit turns on the third switching element, to cause the driving switching element to supply drive current to the light emitting element.

In the initialization period, the first switching element may supply a reference voltage supplied from the data line to the first node, and the second switching element supplies an initialization voltage supplied from the initialization voltage supply line to the second node.

In the sampling period, the first switching element may supply a reference voltage supplied from the data line to the first node. The third switching element may supply a high-level voltage supplied from the high-level voltage supply line to the drain of the driving switching element.

In the programming period, the first switching element may supply the data voltage supplied from the data line to the first node.

In the emission period, the third switching element may supply a high-level voltage supplied from the high-level voltage supply line to the drain of the driving switching element.

The organic light emitting diode display device may further include a second capacitor connected in series to the first capacitor, the second capacitor relatively reducing a capacity ratio of the first capacitor, thereby enhancing a luminance of the light emitting element versus the data voltage applied to the pixel. The second capacitor may be connected between the second node and the high-level voltage supply line, between the second node and the low-level voltage supply line, or between the second node and the initialization voltage supply line.

The light emitting diode display device may further include a first switch for performing switching between an output channel of a data driver and a first data line, and a second switch for performing switching between the output channel of the data driver and a second data line. The first and second switches may be turned on in a sequential manner when one of the pixels, which is connected to the first data line, operates in the programming period thereof, and another one of the pixels, which is connected to the second data line, operates in the programming period thereof, respectively, thereby supplying a data voltage supplied from the output channel of the data driver to the first and second data lines in a sequential manner.

The pixels may operate on a per column basis, and each operation period of the pixels may be divided into a first horizontal period and a second horizontal period subsequent to the first horizontal period. Each of the pixels in a current pixel column may have the initialization period in the first horizontal period thereof, the initialization period of the pixel in the current pixel column corresponding to the sampling period of each of the pixels in a previous pixel column Each of the pixels in the current pixel column may have the sampling period and the programming period in the second horizontal period thereof.

In another aspect of the present invention, a method for driving an organic light emitting diode display device including a plurality of pixels each comprising a light emitting element, and a pixel driving circuit for driving the light emitting element, the pixel driving circuit including a driving switching element connected in series between a high-level voltage supply line and a low-level voltage supply line, together with the light emitting element, a first switching element for connecting a data line and a first node connected to a gate of the driving switching element in response to a first scan signal, a second switching element for connecting an initialization voltage supply line and a second node connected to a source of the driving switching element in response to a second scan signal, a third switching element for connecting the high-level voltage supply line and a drain of the driving switching element in response to an emission signal, and a first capacitor connected between the first node and the second node, includes an initialization step of turning on the first and second switching elements, to initialize the first and second nodes, a sampling step of turning on the first and third switching elements, to sense a threshold voltage of the driving switching element, a programming step of turning on the first switching element, to write a data voltage into the pixel, and an emission step of turning on the third switching element, to cause the driving switching element to supply drive current to the light emitting element.

The initialization step may include turning on the first switching element, to supply a reference voltage supplied from the data line to the first node, and turning on the second switching element, to supply an initialization voltage supplied from the initialization voltage supply line to the second node.

The sampling step may include turning on the first switching element, to supply the reference voltage supplied from the data line to the first node, and turning on the third switching element, to supply a high-level voltage supplied from the high-level voltage supply line to the drain of the driving switching element, whereby a source voltage of the driving switching element is varied to "Vref−Vth", where "Vref" represents the reference voltage, and "Vth" represents the threshold voltage of the driving switching element.

The programming step may include turning on the first switching element, to supply the data voltage supplied from the data line to the first node, and relatively reducing a capacity ratio of the first capacitor by a second capacitor connected between the second node and the high-level voltage supply line, between the second node and the low-level voltage supply line, or between the second node and the initialization voltage supply line, whereby a source voltage of the driving switching element is varied to "Vref−Vth+C'(Vdata−Vref)", where "Vdata" represents the data voltage, "C'" represents "C1/(C1+C2+Coled)", "C1" represents a capacitance of the first capacitor, "C2" represents a capacitance of the second capacitor, and "Coled" represents a capacitance of the light emitting element.

The emission step may include turning on the third switching element, to supply the high-level voltage supplied from the high-level voltage supply line to the drain of the driving switching element, whereby the drive current supplied from the driving switching element to the light emitting element corresponds to "$\frac{1}{2}\times K\ (Vdata-Vref-C'(Vdata-Vref))^2$", where "K" represents a constant determined in accordance with a mobility of the driving switching element and a parasitic capacity of the driving switching element.

The light emitting diode display device may further include a first switch for performing switching between an output channel of a data driver and a first data line, and a second switch for performing switching between the output channel of the data driver and a second data line. The method may further include turning on the first and second switches in a sequential manner when one of the pixels, which is connected to the first data line, operates in the programming period thereof, and another one of the pixels, which is connected to the second data line, operates in the programming period thereof, respectively, thereby supplying a data voltage supplied from an output channel of a data driver to the first and second data lines in a sequential manner.

The pixels may operate on a per column basis, and each operation period of the pixels may be divided into a first horizontal period and a second horizontal period subsequent to the first horizontal period. Each of the pixels in a current pixel column may execute the initialization step in the first horizontal period thereof during execution of the sampling step of each of the pixels in a previous pixel column Each of the pixels in the current pixel column may execute the sampling step and the programming step in the second horizontal period thereof.

In accordance with the present invention, it may be possible to reduce luminance deviation among pixels through compensation for characteristic differences of driving thin film transistors (TFTs) and compensation for voltage drop of a high-level voltage (VDD), thereby achieving an enhancement in picture quality.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and along with the description serve to explain the principle of the invention. In the drawings.

DETAILED DESCRIPTION OF THE INVENTION

Reference will now be made in detail to the preferred embodiments of the present invention associated with an organic light emitting diode display device and a method for driving the same, examples of which are illustrated in the accompanying drawings.

Thin film transistors (TFTs) employed in the present invention may be of a P type or an N type. The following description will be given in conjunction with the case in which TFTs are of an N type, for convenience of description. In this regard, gate high voltage VGH is a gate-on voltage to turn on a TFT, and gate low voltage VGL is a gate-off voltage to turn off a TFT. In explaining pulse type signals, gate high voltage (VGH) state is defined as a "high state", and gate low voltage (VGL) state is defined as a "low state".

Figure 1:
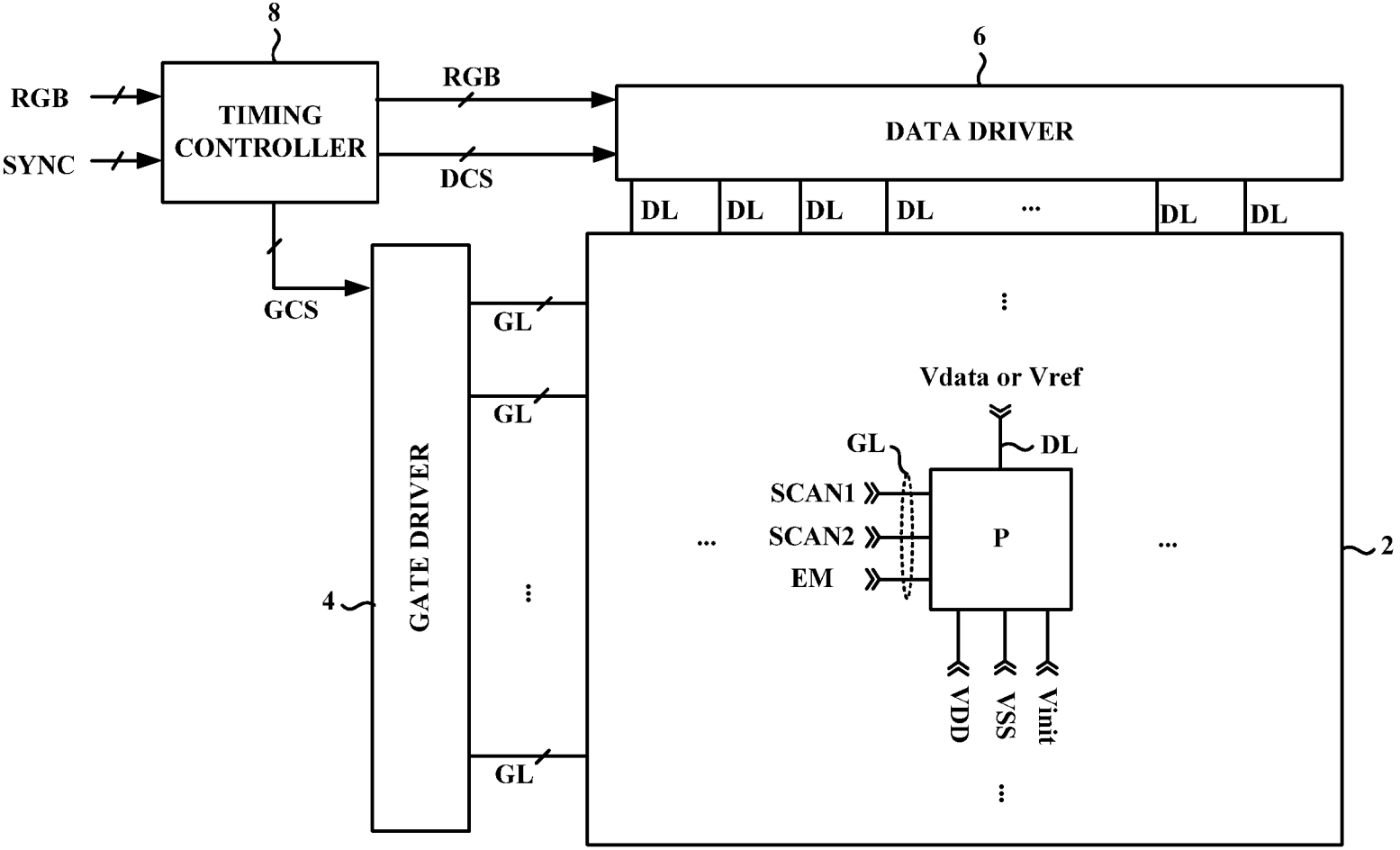
FIG. 1 is a block diagram illustrating a configuration of an organic light emitting diode (OLED) display device according to an exemplary embodiment of the present invention.

FIG. 1 is a block diagram illustrating a configuration of an organic light emitting diode (OLED) display device according to an exemplary embodiment of the present invention.

As illustrated in FIG. 1, the OLED display device includes a display panel 2 including a plurality of pixels P defined in accordance with intersection of a plurality of gate lines GL and a plurality of data lines DL, a gate driver 4 for driving the plural gate lines GL, and a data driver 6 for driving the plural data lines DL. The OLED display device also includes a timing controller 8 for arranging image data RGB input from outside of the OLED display device, supplying the arranged image data RGB to the data driver 6, and outputting gate control signals GCS and data control signals DCS, to control the gate driver 4 and data driver 6.

Each pixel P includes an OLED, and a pixel driving circuit. The pixel driving circuit includes a driving TFT DT, to independently drive the OLED. The pixel driving circuit is configured to compensate for characteristic deviation of the driving TFT DT and to compensate for voltage drop of a high level voltage VDD. Thus, it is possible to reduce luminance deviation among the pixels P. The pixels P according to the present invention will be described in detail with reference to FIGS. 2 to 6.

The display panel 2 includes the intersecting plural gate lines GL and plural data lines DL. The pixels P are arranged in intersection regions of the gate and data lines GL and DL. As described above, each pixel P includes one OLED and one pixel driving circuit. Each pixel P is connected to one gate line GL, one data line DL, a high level voltage supply line for a high level voltage VDD, a low level voltage supply line for a low level voltage VSS, and an initialization voltage supply line for an initialization voltage Vinit.

The gate driver 4 supplies a plurality of gate signals to the plural gate lines GL in accordance with a plurality of gate control signals GCS supplied from the timing controller 8. The plural gate signals include first and second scan signals SCAN1 and SCAN2, and an emission signal EM. These signals are supplied to each pixel P by the plural gate lines GL. The high level voltage VDD has a higher level than the low level voltage VSS. The low level voltage VSS may be a ground voltage. The initialization voltage Vinit has a lower level than a threshold voltage of the OLED of each pixel P.

The data driver 6 converts digital image data RGB input from the timing controller 8 into a data voltage Vdata in accordance with a plurality of data control signals DCS supplied form the timing controller 8, using a reference gamma voltage. The data driver 6 supplies the converted data voltage Vdata to the plural data lines DL. The data driver 6 outputs the data voltage Vdata only in a programming period t3 (FIG. 2) of each pixel P. In a period other than the programming period, the data driver 6 outputs a reference voltage Vref to the plural data lines DL.

The timing controller 8 arranges the externally input image data RGB, to match the size and resolution of the display panel 2, and then supplies the arranged image data to the data driver 6. The timing controller 8 generates a plurality of gate control signals GCS and a plurality of data control signals DCS, using synchronization signals input from outside of the display device, for example, a dot clock DCLK, a data enable signal DE, a horizontal synchronization signal Hsync, and a vertical synchronization signal Vsync. The timing controller 8 supplies the generated gate control signals GCS and data control signals DCS to the gate driver 4 and data driver 6, respectively, for control of the gate driver 4 and data driver 6.

Hereinafter, each pixel P of the present invention will be described in detail.

Figure 2:
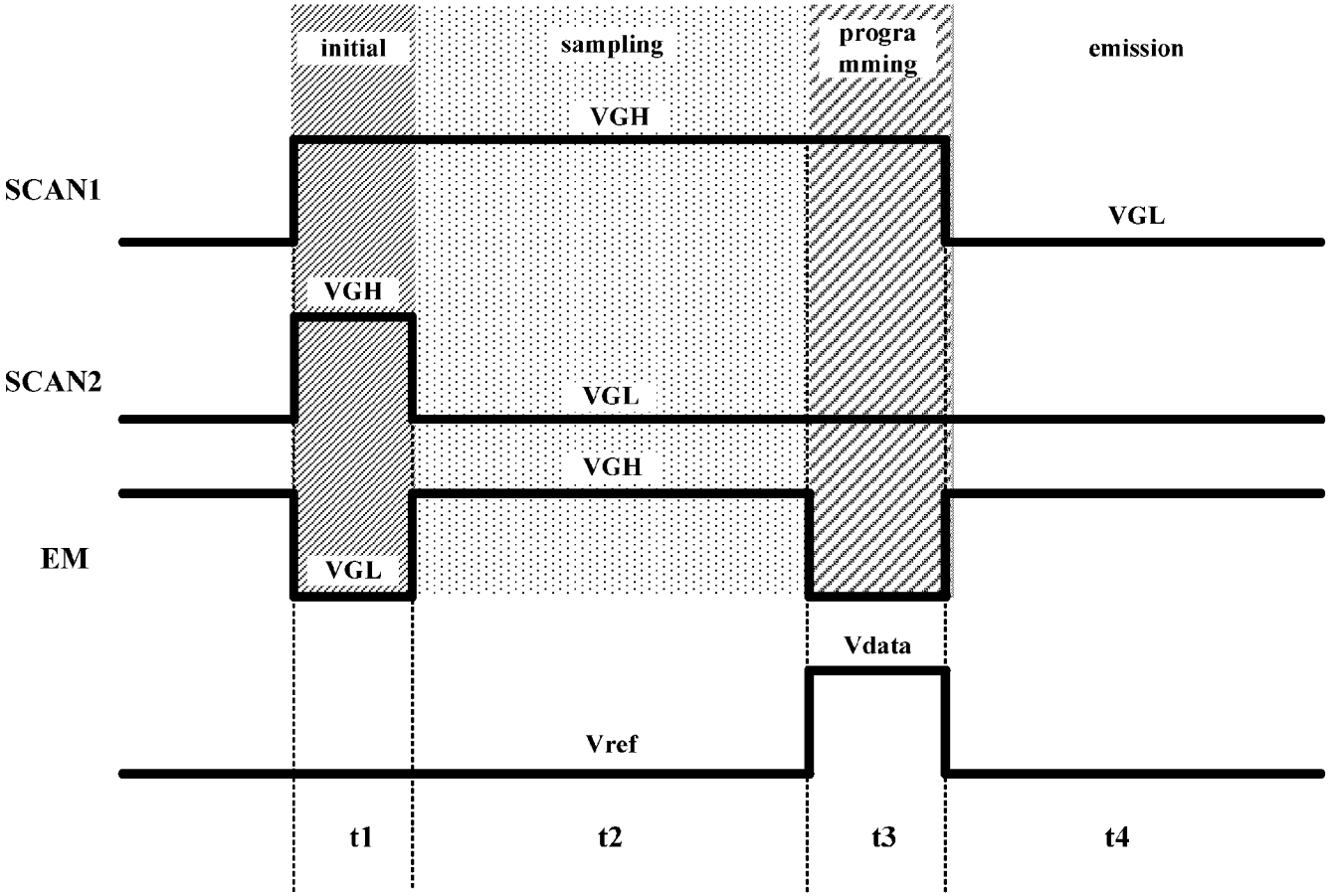
FIG. 2 is a driving waveform diagram of each pixel P illustrated in FIG. 1.
Figure 3:
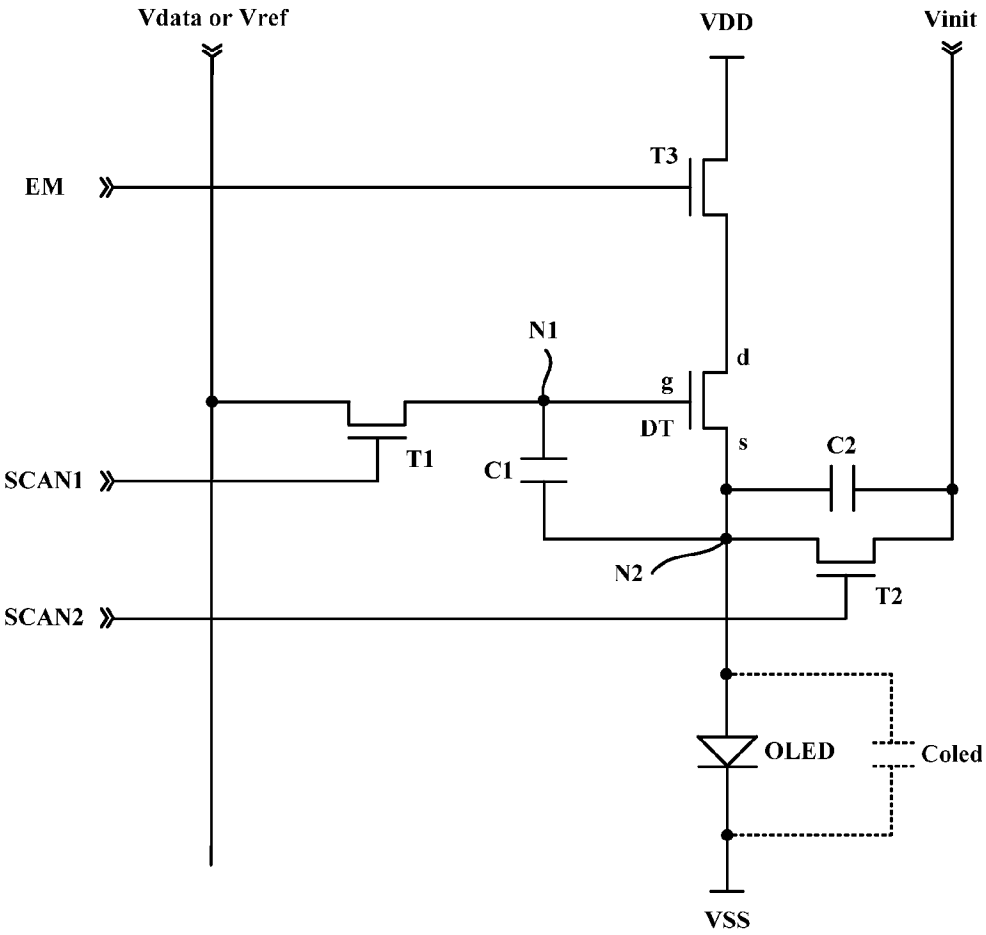
FIG. 3 is a circuit diagram of each pixel P illustrated in FIG. 1.
Figure 4A:
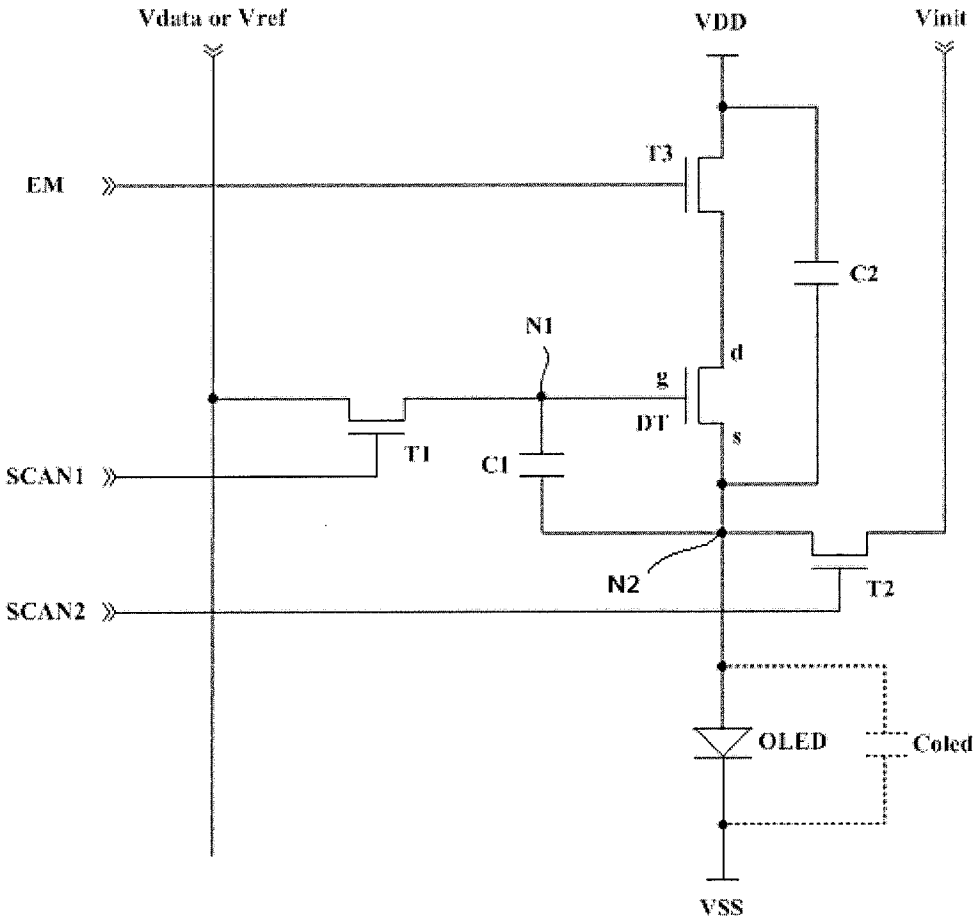
FIGS. 4A and 4B are circuit diagrams of each pixel P according to other embodiments of the present invention, respectively.
Figure 4B:
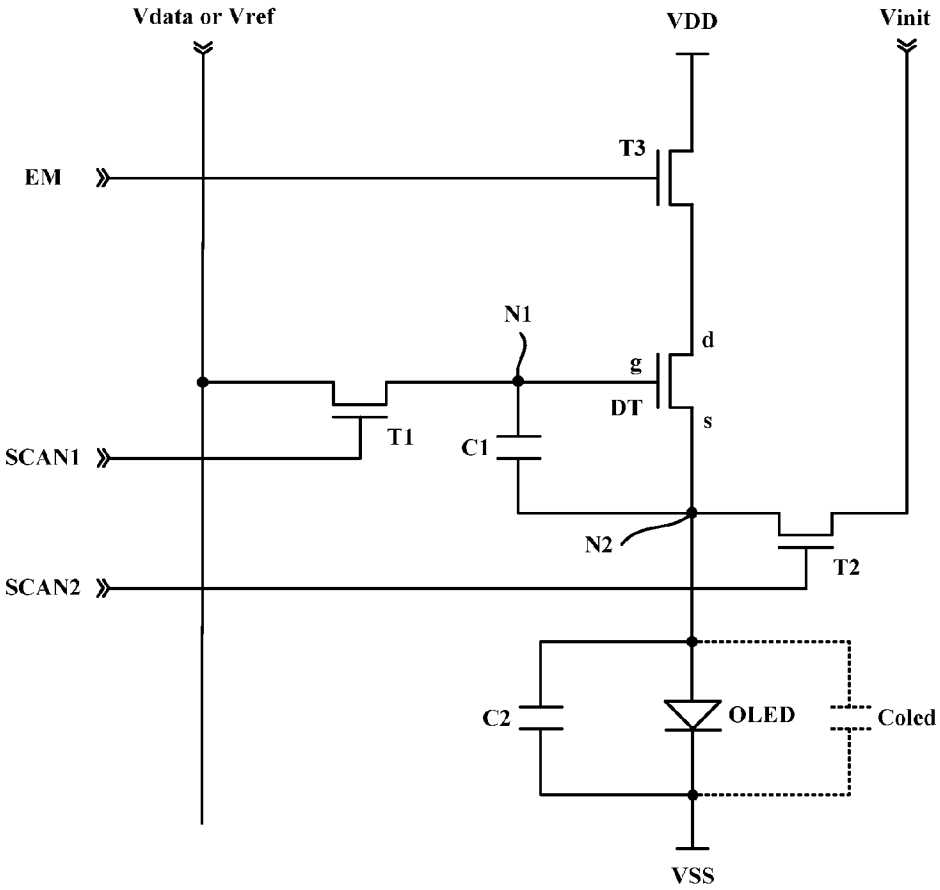

FIG. 2 is a driving waveform diagram of each pixel P illustrated in FIG. 1. FIG. 3 is a circuit diagram of each pixel P illustrated in FIG. 1. FIGS. 4A and 4B are circuit diagrams of each pixel P according to other embodiments of the present invention, respectively.

Referring to FIG. 2, each pixel P of the present invention operates in a plurality of periods divided in accordance with a plurality of gate signals supplied to the pixel P, that is, an initialization period t1, a sampling period t2, a programming period t3, and an emission period t4.

In the initialization period t1, the first and second scan signals SCAN1 and SCAN2 are output at a high level, and the emission signal EM is output at a low level. In the sampling period t2, the first scan signal SCAN1 and emission signal EM are output at a high level, and the second scan signal SCAN2 is output at a low level. In the programming period t3, the first scan signal SCAN1 is output at a high level, and the second scan signal SCAN2 and emission signal EM are output at a low level. In the emission period t4, the emission signal EM is output at a high level, and the first and second scan signals SCAN1 and SCAN2 are output at a low level. Meanwhile, the data diver 6 supplies data voltage Vdata to the plural data lines DL in sync with the programming period t3 of each pixel P. In periods other than the programming period t3 of each pixel P, the data driver 6 supplies a reference voltage Vref to the plural data lines DL.

Referring to FIG. 3, each pixel P includes one OLED, and one pixel driving circuit including four TFTs and two capacitors, to drive the OLED. In detail, the pixel driving circuit includes one driving TFT DT, and first to third TFTs T1 to T3, and first and second capacitors C1 and C2.

The driving TFT DT is connected in series between the VDD supply line and the VSS supply line, together with the OLED. In the emission period t4, the driving TFT DT supplies drive current to the OLED.

The first TFT T1 is turned on or off in accordance with the first scan signal SCAN1. When the first TFT T1 is turned on, the data line DL is connected to a first node N1 connected to a gate of the driving TFT DT. The first TFT T1 supplies, to the first node N1, the reference voltage Vref supplied from the data line DL in the initialization period t1 and sampling period t2. In the programming period t3, the first TFT T1 supplies, to the first node N1, data voltage Vdata supplied from the data line DL.

The second TFT T2 is turned on or off in accordance with the second scan signal SCAN2. When the second TFT T2 is turned on, the initialization voltage Vinit is connected to a second node N2 connected to a source of the driving TFT DT.

The second TFT T2 supplies, to the second node N2, the initialization voltage Vinit supplied from the Vinit supply line in the initialization period t1.

The third TFT T3 is turned on or off in accordance with the emission signal EM. When the third TFT T3 is turned on, the high level voltage VDD is supplied to a drain of the driving TFT DT. In the sampling period t2 and emission period t4, the third TFT T3 supplies, to the drain of the driving TFT DT, a high level voltage VDD supplied from the VDD supply line.

The first capacitor C1 is connected between the first node N1 and the second node N2. The first capacitor C1 stores the threshold voltage Vth of the driving TFT DT in the sampling period t2.

The second capacitor C2 is connected between the Vinit supply line and the second node N2. The second capacitor C2 is connected to the first capacitor C1 in series and, as such, relatively reduces the capacity ratio of the first capacitor C1. Thus, the second capacitor C2 functions to enhance the luminance of the OLED versus the data voltage Vdata applied to the first node N1 in the programming period t3. Meanwhile, as illustrated in FIG. 4A, the second capacitor C2 may be connected between the VDD supply line and the second node N2. Alternatively, the second capacitor C2 may be connected between the VSS supply line and the second node N2, as illustrated in FIG. 4B.

Hereinafter, a method for driving each pixel P in accordance with an exemplary embodiment of the present invention will be described with reference to FIGS. 2 and 3.

First, in the initialization period t1, the first and second TFTs T1 and T2 are turned on. Then, the reference voltage Vref is supplied to the first node N1 via the first TFT T1. The initial voltage Vinit is supplied to the second node N2. As a result, the pixel P is initialized.

Subsequently, in the sampling period t2, the first and third TFTs T1 and T3 are turned on. Then, the first node N1 sustains the reference voltage Vref. Meanwhile, in the driving TFT DT, current flows toward the source in a state in which the drain is floated by the high level voltage VDD. When the source voltage of the driving TFT DT is equal to "Vref−Vth", the driving TFT DT is turned off. Here, "Vth" represents the threshold voltage of the driving TFT DT.

Thereafter, in the programming period t3, the first TFT T1 is turned on. Then, the data voltage Vdata is supplied to the first node N1 via the first TFT T1.

As a result, the voltage of the second node N2 is varied to "Vref−Vth+C' (Vdata−Vref)" due to a coupling phenomenon thereof caused by voltage distribution according to in-series connection of the first and second capacitors C1 and C2. Here, "C'" represents "C1/(C1+C2+Coled)". "Coled" represents the capacitance of the OLED. In accordance with the present invention, the capacity ratio of the first capacitor C1 is relatively reduced in accordance with provision of the second capacitor C2 connected to the first capacitor C1 in series. Accordingly, it is possible to enhance the luminance of the OLED versus the data voltage Vdata applied to the first node N1 in the programming period t3.

Subsequently, in the emission period t4, the third TFT T3 is turned on. Then the high level voltage VDD is applied to the drain of the driving TFT DT via the third TFT T3. As a result, the driving TFT DT supplies drive current. In this case, the drive current supplied from the driving TFT DT to the OLED is expressed by an expression "$\frac{1}{2}\times K\,(Vdata-Vref-C'(Vdata-Vref))^2$". "K" represents a constant determined in accordance with a mobility of the driving TFT DT and a parasitic capacity of the driving TFT DT. Referring to this expression, it can be seen that the drive current of the OLED is not influenced by the threshold voltage Vth of the driving TFT DT and the high level voltage VDD. Accordingly, it is possible to reduce luminance deviation of the pixels P through compensation for characteristic differences of driving TFTs DT and compensation for voltage drop of the high level voltage VDD. Meanwhile, in accordance with the present invention, it may be possible to compensate for mobility deviation of the driving TFTs DT by adjusting an ascending time of the emission signal EM transitioning from a low state to a high state at a start point of the emission period t4.

Figure 5:
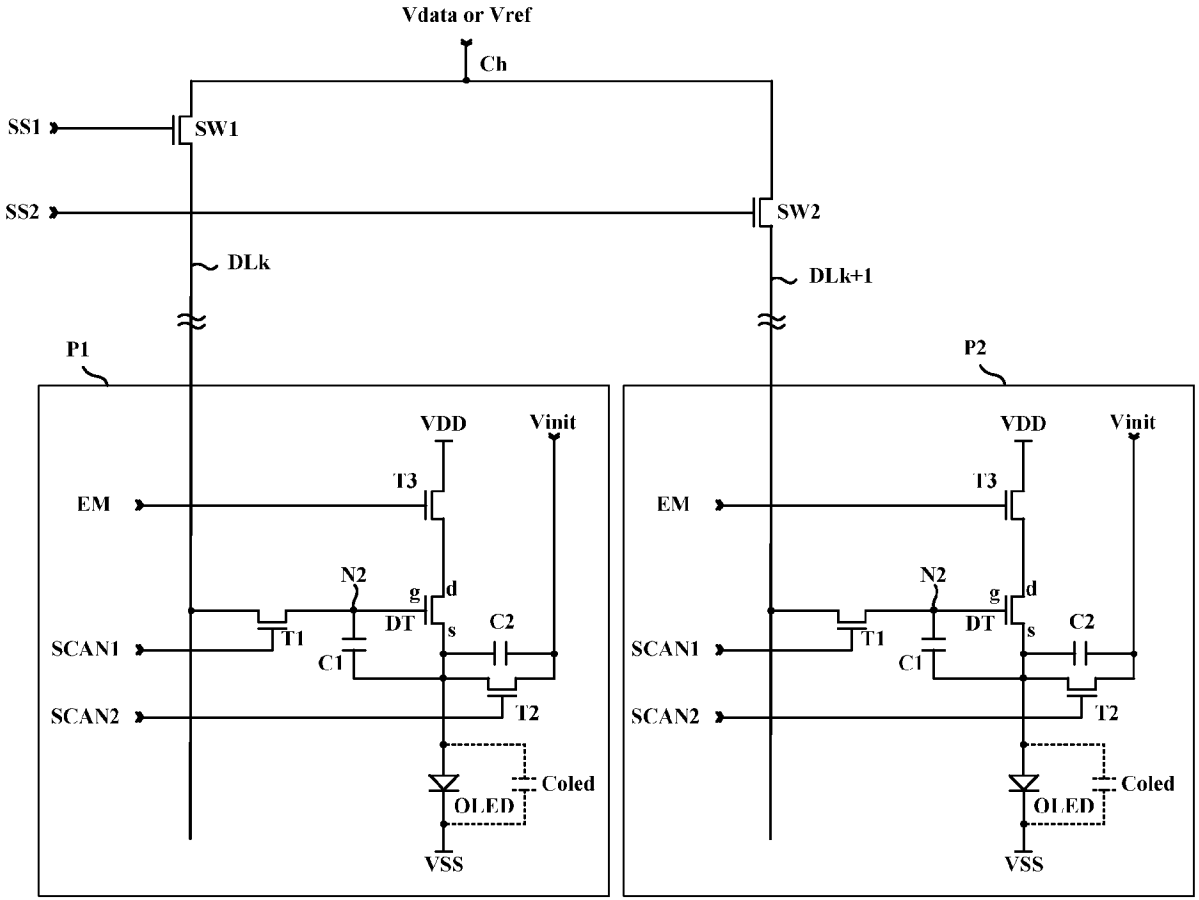
FIG. 5 is a circuit diagram illustrating a configuration of an OLED display device according to another embodiment of the present invention.
Figure 6:
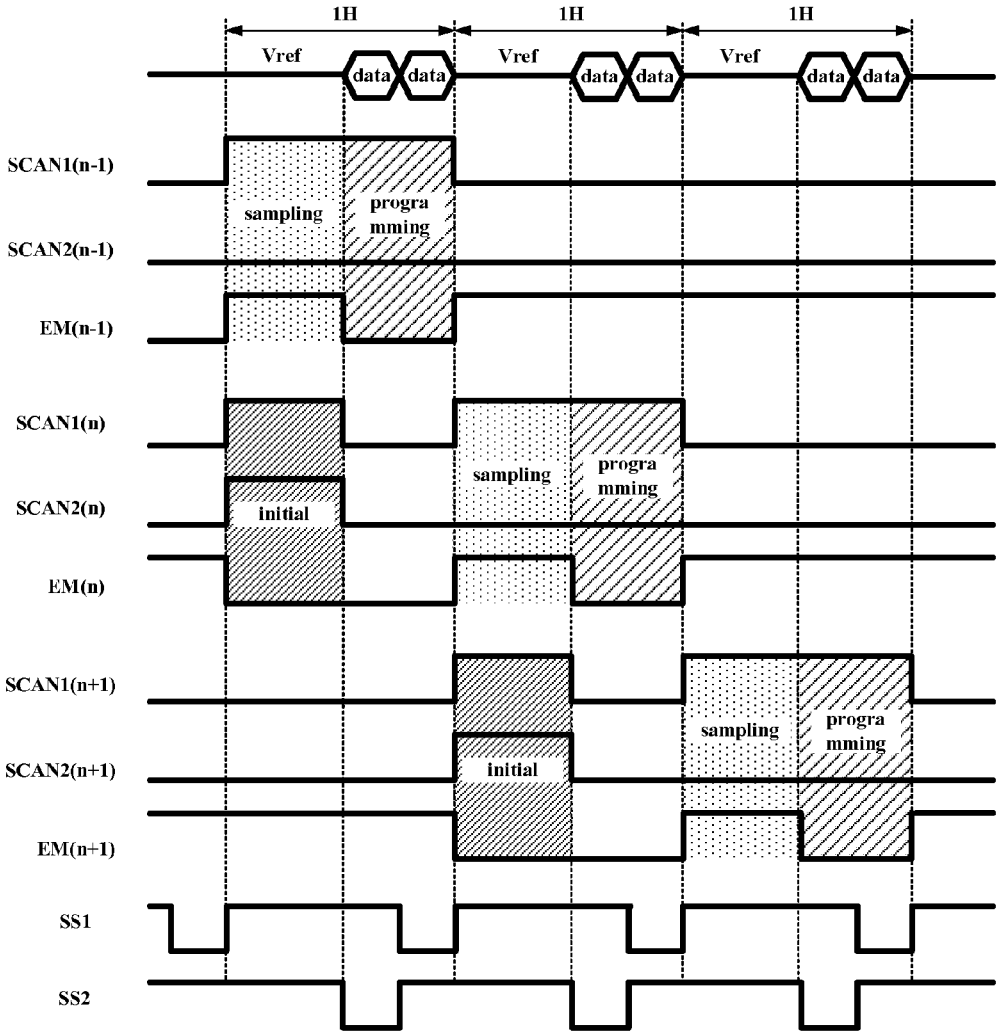
FIG. 6 is a driving waveform diagram of the OLED display device illustrated in FIG. 5.

FIG. 5 is a circuit diagram illustrating a configuration of an OLED display device according to another embodiment of the present invention. FIG. 6 is a driving waveform diagram of the OLED display device illustrated in FIG. 5.

The OLED display device illustrated in FIG. 5 is basically identical to that of FIG. 3 in terms of the configuration and driving method of pixels P. However, the OLED display device of FIG. 5 may reduce the number of channels Ch of the data driver 6 while securing an increased initialization period t1 and an increased sampling period t2 in accordance with application of 1:2 multiplexing (MUX) driving of the data voltage Vdata and, as such, may achieve a further enhancement in the ability to compensate for characteristic differences of driving TFTs and voltage drop of the high-level voltage (VDD).

In detail, the OLED display device illustrated in FIG. 5 includes a first switch SW1 for performing switching between an output channel Ch of the data driver 6 and a first data line DLk in response to a first switching signal SS1, and a second switch SW2 for performing switching between the output channel Ch of the data driver 6 and a second data line DLk+1 in response to a second switching signal SS2. The first and second data lines DLk and DLk+1 may be odd and even-numbered data lines, respectively, or vice versa. The first and second switches SW1 and SW2 may be formed in a peripheral non-display area of the display panel 2. Of course, the first and second switches SW1 and SW2 may be internally equipped in the data driver 6.

Hereinafter, a method for driving the above-described OLED display device will be described with reference to FIGS. 5 and 6.

The first and second switching signals SS1 and SS2 are initially output at a high level, and are subsequently output at a low level in a sequential member in sync with the programming period t3 of the pixels P1 of each pixel column In detail, the first switching signal SS1 is output at a high level in sync with the programming period t3 of the pixels P1 of the pixel column connected to the first data line DLk, whereas the second switching signal SS2 is output at a low level in sync with this period. Subsequently, the first switching signal SS1 is output at a low level in sync with the programming period t3 of the pixels P2 of the pixel column connected to the second data line DLk+1, whereas the second switching signal SS2 is output at a high level in sync with this period. Thus, in the programming period t3, the pixels P1 of the pixel column connected to the first data line DLk and the pixels P2 of the pixel column connected to the second data line DLk+1 receive the data voltage Vdata in a sequential manner.

Meanwhile, the pixels P of each pixel column have an initialization period T1, a sampling period t2, and a programming period t3 within two horizontal periods 2H. That is, the pixels P of each pixel column have an initialization period t1 within a first horizontal period corresponding to a second horizontal period of the pixels P of the previous pixel column in which the sampling period t2 and programming period t3 are present (in more detail, corresponding to the sampling period t2 of the pixels P of the previous column). In addition, the pixels P of each pixel column have a sampling period t2 and a programming period t3 within a second horizontal period subsequent to the first horizontal period.

The above-described OLED display device may reduce the number of channels Ch of the data driver 6 while increasing the initialization period t1 and sampling period t2 of each pixel P in accordance with application of 1:2 multiplexing (MUX) driving of the data voltage Vdata. Accordingly, it may be possible to achieve a further enhancement in the ability to compensate for characteristic differences of driving TFTs and voltage drop of the high-level voltage (VDD).

As apparent from the above description, in accordance with the present invention, it may be possible to reduce luminance deviation among pixels through compensation for characteristic differences of driving thin film transistors (TFTs) and compensation for voltage drop of a high-level voltage (VDD), thereby achieving an enhancement in picture quality.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. An organic light emitting diode display device comprising:

a plurality of pixels each comprising a light emitting element, and a pixel driving circuit for driving the light emitting element, wherein the pixel driving circuit comprises:

a driving switching element connected in series between a high-level voltage supply line and a low-level voltage supply line, together with the light emitting element, a first switching element for connecting a data line and a first node connected to a gate of the driving switching element in response to a first scan signal, a second switching element for connecting an initialization voltage supply line and a second node connected to a source of the driving switching element in response to a second scan signal, a third switching element for connecting the high-level voltage supply line and a drain of the driving switching element in response to an emission signal, and a first capacitor connected between the first node and the second node, wherein the pixel driving circuit operates in a period divided into an initialization period in which the pixel driving circuit turns on the first and second switching elements, to initialize the first and second nodes, a sampling period in which the pixel driving circuit turns on the first and third switching elements, to sense a threshold voltage of the driving switching element, a programming period in which the pixel driving circuit turns on the first switching element, to write a data voltage into the pixel, and an emission period in which the pixel driving circuit turns on the third switching element, to cause the driving switching element to supply drive current to the light emitting element, and wherein:

the pixels operate on a per column basis, and each operation period of the pixels is divided into a first horizontal period and a second horizontal period subsequent to the first horizontal period;

each of the pixels in a current pixel column has the initialization period in the first horizontal period thereof, the initialization period of the pixel in the current pixel column corresponding to the sampling period of each of the pixels in a previous pixel column; and each of the pixels in the current pixel column has the sampling period and the programming period in the second horizontal period thereof.

2. The organic light emitting diode display device according to claim 1, wherein, in the initialization period, the first switching element supplies a reference voltage supplied from the data line to the first node, and the second switching element supplies an initialization voltage supplied from the initialization voltage supply line to the second node.

3. The organic light emitting diode display device according to claim 1, wherein, in the sampling period, the first switching element supplies a reference voltage supplied from the data line to the first node, and the third switching element supplies a high-level voltage supplied from the high-level voltage supply line to the drain of the driving switching element.

4. The organic light emitting diode display device according to claim 1, wherein, in the programming period, the first switching element supplies the data voltage supplied from the data line to the first node.

5. The organic light emitting diode display device according to claim 1, wherein, in the emission period, the third switching element supplies a high-level voltage supplied from the high-level voltage supply line to the drain of the driving switching element.

6. The organic light emitting diode display device according to claim 1, further comprising:

a second capacitor connected in series to the first capacitor, the second capacitor relatively reducing a capacity ratio of the first capacitor, thereby enhancing a luminance of the light emitting element versus the data voltage applied to the pixel, wherein the second capacitor is connected between the second node and the high-level voltage supply line, between the second node and the low-level voltage supply line, or between the second node and the initialization voltage supply line.

7. The light emitting diode display device according to claim 1, further comprising:

a first switch for performing switching between an output channel of a data driver and a first data line; and a second switch for performing switching between the output channel of the data driver and a second data line, wherein the first and second switches are turned on in a sequential manner when one of the pixels, which is connected to the first data line, operates in the programming period thereof, and another one of the pixels, which is connected to the second data line, operates in the programming period thereof, respectively, thereby supplying a data voltage supplied from the output channel of the data driver to the first and second data lines in a sequential manner.

8. A method for driving an organic light emitting diode display device including a plurality of pixels each comprising a light emitting element, and a pixel driving circuit for driving the light emitting element, the pixel driving circuit including a driving switching element connected in series between a high-level voltage supply line and a low-level voltage supply line, together with the light emitting element, a first switching element for connecting a data line and a first node connected to a gate of the driving switching element in response to a first scan signal, a second switching element for connecting an initialization voltage supply line and a second node connected to a source of the driving switching element in response to a second scan signal, a third switching element for connecting the high-level voltage supply line and a drain of the driving switching element in response to an emission signal, and a first capacitor connected between the first node and the second node, the method comprising:

an initialization step of turning on the first and second switching elements, to initialize the first and second nodes;

a sampling step of turning on the first and third switching elements, to sense a threshold voltage of the driving switching element;

a programming step of turning on the first switching element, to write a data voltage into the pixel; and an emission step of turning on the third switching element, to cause the driving switching element to supply drive current to the light emitting element, wherein:

the pixels operate on a per column basis, and each operation period of the pixels is divided into a first horizontal period and a second horizontal period subsequent to the first horizontal period;

each of the pixels in a current pixel column executes the initialization step in the first horizontal period thereof during execution of the sampling step of each of the pixels in a previous pixel column; and each of the pixels in the current pixel column executes the sampling step and the programming step in the second horizontal period thereof.

9. The method according to claim 8, wherein the initialization step comprises:

turning on the first switching element, to supply a reference voltage supplied from the data line to the first node; and turning on the second switching element, to supply an initialization voltage supplied from the initialization voltage supply line to the second node.

10. The method according to claim 9, wherein the sampling step comprises:

turning on the first switching element, to supply the reference voltage supplied from the data line to the first node; and turning on the third switching element, to supply a high-level voltage supplied from the high-level voltage supply line to the drain of the driving switching element, whereby a source voltage of the driving switching element is varied to "Vref−Vth", where "Vref" represents the reference voltage, and "Vth" represents the threshold voltage of the driving switching element.

11. The method according to claim 10, wherein the programming step comprises:

turning on the first switching element, to supply the data voltage supplied from the data line to the first node; and relatively reducing a capacity ratio of the first capacitor by a second capacitor connected between the second node and the high-level voltage supply line, between the second node and the low-level voltage supply line, or between the second node and the initialization voltage supply line, whereby a source voltage of the driving switching element is varied to "Vref−Vth+C'(Vdata−Vref)", where "Vdata" represents the data voltage, "C'" represents "C1/(C1+C2+Coled)", "C1" represents a capacitance of the first capacitor, "C2" represents a capacitance of the second capacitor, and "Coled" represents a capacitance of the light emitting element.

12. The method according to claim 11, wherein the emission step comprises:

turning on the third switching element, to supply the high-level voltage supplied from the high-level voltage supply line to the drain of the driving switching element, whereby the drive current supplied from the driving switching element to the light emitting element corresponds to "$\frac{1}{2}\times K\ (Vdata-Vref-C'(Vdata-Vref))^2$", where "K" represents a constant determined in accordance with a mobility of the driving switching element and a parasitic capacity of the driving switching element.

13. The method according to claim 8, wherein:

the light emitting diode display device further includes a first switch for performing switching between an output channel of a data driver and a first data line, and a second switch for performing switching between the output channel of the data driver and a second data line; and the method further comprises turning on the first and second switches in a sequential manner when one of the pixels, which is connected to the first data line, operates in the programming period thereof, and another one of the pixels, which is connected to the second data line, operates in the programming period thereof, respectively, thereby supplying a data voltage supplied from an output channel of a data driver to the first and second data lines in a sequential manner.

* * * * *